US008453273B1

(12) United States Patent
Morad

(10) Patent No.: US 8,453,273 B1
(45) Date of Patent: Jun. 4, 2013

(54) SCENT IMPREGNATED ATTACHMENT APPARATUS AFFIXED TO THE FLEXIBLE CONNECTING BELT OF A RIMMED CAGE RETAINING A DEODORANT BLOCK

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 695 days.

(21) Appl. No.: 12/657,711

(22) Filed: Jan. 25, 2010

(51) Int. Cl.
*E03D 9/00* (2006.01)

(52) U.S. Cl.
USPC ..... 4/228.1; 4/222

(58) Field of Classification Search
USPC ..... 4/228.1, 31, 223, 222
See application file for complete search history.

(56) References Cited

U.S. PATENT DOCUMENTS

| | | | | |
|---|---|---|---|---|
| 4,555,819 | A * | 12/1985 | Weiss et al. | 4/223 |
| 7,832,025 | B2 * | 11/2010 | Virica et al. | 4/227.4 |
| 8,051,503 | B2 * | 11/2011 | Nguyen et al. | 4/223 |
| 2009/0235443 | A1 * | 9/2009 | Arora et al. | 4/231 |
| 2010/0212074 | A1 * | 8/2010 | Burt et al. | 4/231 |

* cited by examiner

*Primary Examiner* — Huyen Le
(74) *Attorney, Agent, or Firm* — Thomas I. Rozsa

(57) ABSTRACT

A molded object made out of resin, plastic or other suitable scent absorbing material which is impregnated with an odor absorbing scent. The scent impregnated object which be in any shape such as the shape of an animal, a celestial body (star, moon, etc) or any other shape is retained onto the flexible retaining belt by which a rimmed cage retaining a deodorant block is retained onto the upper exterior rim of a toilet bowl. The rimmed cage retaining the deodorant block extends into the toilet bowl and the present invention odor absorbing object rests just above the rimed cage and provides a continuous source of scent to absorb fowl odors and mask fowl odors from the toilet bowl.

8 Claims, 4 Drawing Sheets

SCENT IMPREGNATED ATTACHMENT APPARATUS AFFIXED TO THE FLEXIBLE CONNECTING BELT OF A RIMMED CAGE RETAINING A DEODORANT BLOCK

BACKGROUND OF THE INVENTION

1. Field of the Invention

The present invention relates to the field of deodorant retaining mechanisms which retain a deodorant block over a toilet bowl rim to help reduced smells from the toilet bowl.

2. Description of the Prior Art

In general, the apparatus which is a rimmed open cage which retains a deodorant block and is affixed to the upper edge of a toilet bowl rim by a flexible connecting belt is known. The deodorant block retained in the rimmed cage is only activated when the deodorant block come sin contact with water. Therefore, its primary purpose is to reduce foul smells after the toilet bowl has been used and is flushed, to hereby activate the deodorant block while it is wet to reduce foul smells. However, if the toilet is not used for several hours, then the deodorant block is inactive and foul smells can still emanate from the toilet bowl and permeate the bathroom.

There is a significant need to improve upon this apparatus to help eliminate or mask fowl smells from the toilet bowl resulting from use by having urine and feces deposited into the toilet bowl during use and which scent is continuous and adjacent to the toilet bowl and which does not require activation by water for the scent to permeate the air in the bathroom.

SUMMARY OF THE INVENTION

The present invention is a molded object made out of resin, plastic or other suitable scent absorbing material which is impregnated with an odor absorbing scent. The scent impregnated object which be in any shape such as the shape of an animal, a celestial body (star, moon, etc) or any other shape is retained onto the flexible retaining belt by which a rimmed cage retaining a deodorant block is retained onto the upper exterior rim of a toilet bowl. The rimmed cage retaining the deodorant block extends into the toilet bowl and the present invention odor absorbing object rests just above the rimed cage and provides an additional source of scent to absorb fowl odors and mask fowl odors from the toilet bowl. However, a key feature of the present invention is that the object emits its odor absorbing scent and also provides a pleasant air freshening function without requiring any activation from water or any other source. Therefore, the pleasant smell is continuously provided to freshen the bathroom air.

It is an object of the present invention to provide a scent impregnated object which is retained on the retaining mechanism by which a rimmed cage retaining a deodorant block is removably affixed to the exterior rim of a toilet bowl to thereby provide an additional source of pleasant scent within the toilet bowl, which source of pleasant odor absorbing smell is continuous and does not require any activation by water or anything else.

It is an additional object of the present invention to provide a continuous smell absorbing object which is retained on the retaining mechanism by which a rimmed cage retaining a deodorant block is removably affixed to the exterior rim of a toilet bowl to thereby provide a continuous source to absorb fowl smells from within the toilet bowl.

It is also an object of the present invention to form the additional scent impregnated and smell absorbing object into an attractive shape such as the shape of an animal or other figure.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
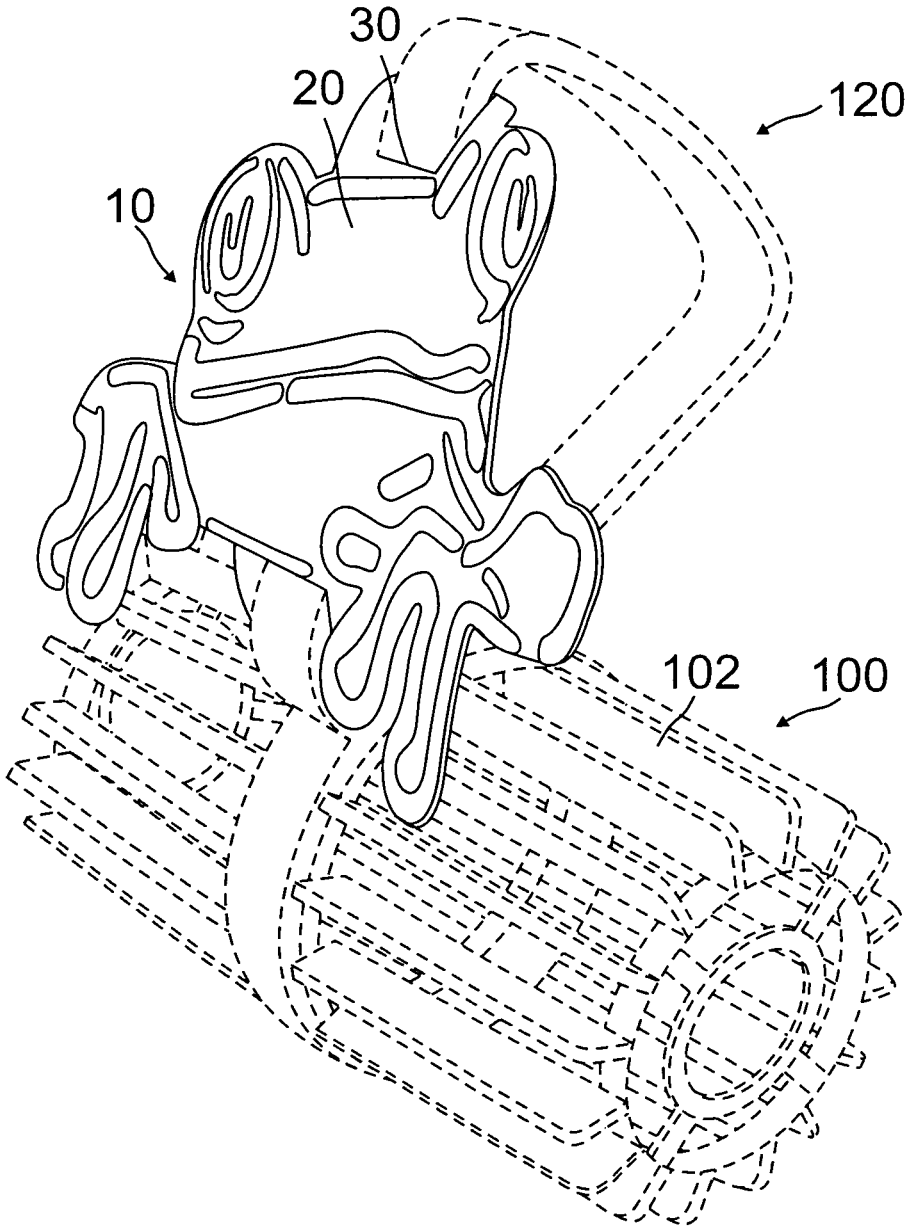
FIG. 1 is a perspective view of the present invention scent impregnated object which is in the shape of a frog retained on the flexible retaining belt by which a rimmed cage retaining a deodorant block is removably retained onto the upper exterior rim of a toilet bowl, the flexible belt and rimmed cage shown in dashed lines, the deodorant block removed for clarify of illustration.
Figure 2:
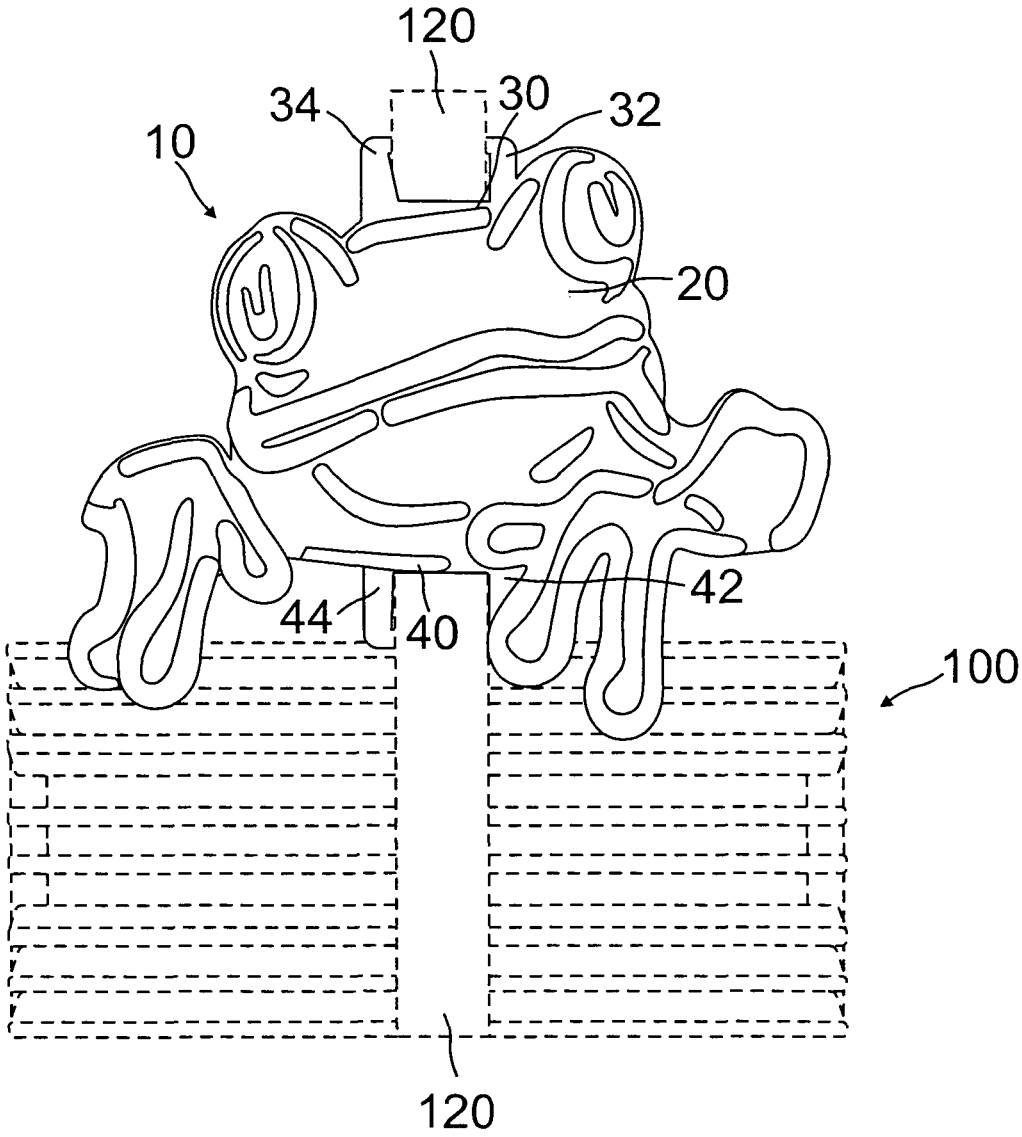
FIG. 2 is a front view of the present invention scent impregnated object which is in the shape of a frog retained on the flexible retaining belt by which a rimmed cage retaining a deodorant block is removably retained onto the upper exterior rim of a toilet bowl, the flexible belt and rimmed cage shown in dashed lines, the deodorant block removed for clarify of illustration.
Figure 3:
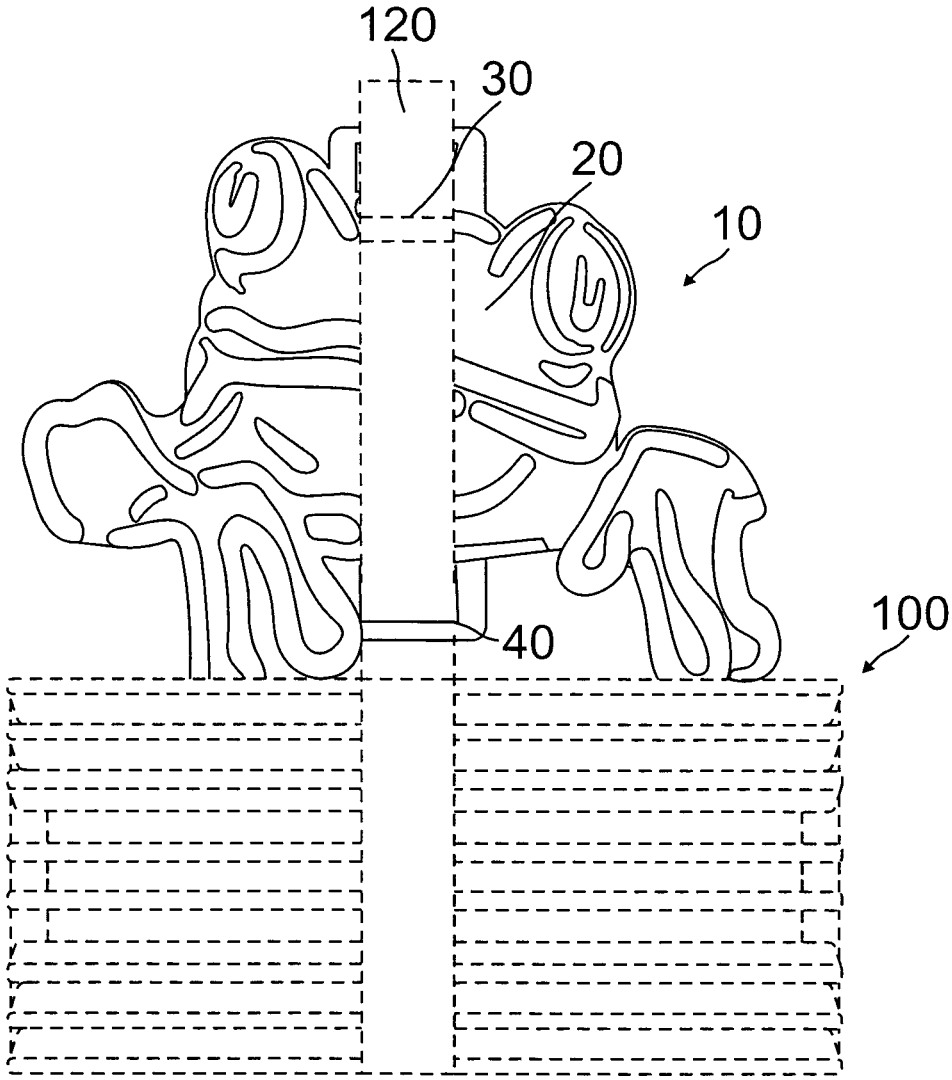
FIG. 3 is a rear view of the present invention scent impregnated object which is in the shape of a frog retained on the flexible retaining belt by which a rimmed cage retaining a deodorant block is removably retained onto the upper exterior rim of a toilet bowl, the flexible belt and rimmed cage shown in dashed lines, the deodorant block removed for clarify of illustration.
Figure 4:
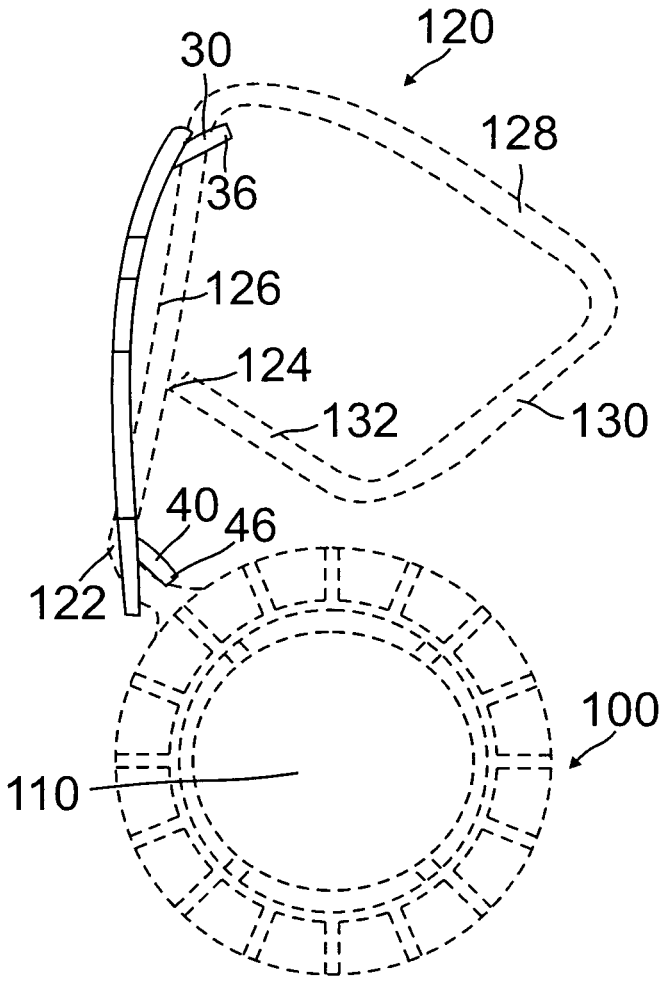
FIG. 4 is a side view of the present invention scent impregnated object which is in the shape of a frog retained on the flexible retaining belt by which a rimmed cage retaining a deodorant block is removably retained onto the upper exterior rim of a toilet bowl, the flexible belt and rimmed cage shown in dashed lines, the deodorant block also shown in dashed lines.

Referring to FIGS. 1 through 4, there is illustrated a preferred embodiment of the present invention scent impregnated object 10 which is in the shape of a frog retained on the flexible retaining belt 120 by which a rimmed cage 100 retaining a deodorant block 110 is removably retained onto the upper exterior rim of a toilet bowl, the flexible belt 120 and rimmed cage 100 shown in dashed lines, the deodorant block 110 removed from FIGS. 1 through 3 for clarity of illustration and only shown in FIG. 4, the deodorant block 110 also shown in dashed lines.

In common use today is a rimmed cage 100 which retains therein a deodorant block 110, the rimmed cage 100 having numerous openings 102 so that the deodorant block 110 an permeate the area surrounding the rimmed cage 100 with a scent absorbing smell. However, the deodorant block 110 is only activated when it comes in contact with water such as after the toilet bowl is flushed. Therefore, the odor adsorbing properties of the deodorant block only last for a short period of time after the toilet bowl is flushed. Thereafter, any remaining fowl smells remain in the bathroom.

A flexible belt 120 is affixed at its proximal end 122 to the rimmed cage 100. The flexible belt 120 is formed as an elongated belt having a first lengthwise section 126, a second transverse section 128, a third lengthwise section 130 and a fourth transverse section 132 terminating in a distal end 124. The flexible belt 120 is made out of spring like material. In use, the flexible belt 120 is positioned over the exterior rim of a toilet bowl so that the distal end 124 is outside the toilet bowl, the sections of the flexible belt 120 resting over the rim of the toilet bowl so that the first lengthwise section 126 and the rimmed cage 100 extend into the toilet bowl and are retained adjacent the interior wall of the toilet bowl above the water line within the toilet bowl. The spring tension of the flexible belt 120 retains the flexible belt 120 onto the toilet bowl rim. In this way, the deodorant block is within the toilet bowl and can absorb and mask fowl smells resulting from urine and feces deposited into the toilet bowl after the toilet is flushed to activate the deodorant block for a short period of time. It will be appreciated that any type of flexible belt can be used and the one described is for illustrative purposes only. The rimmed cage 100 can also be any shape and design and the one illustrated is for illustrative purposes only.

The present invention is a scent impregnated object 10 which has body 20 having an upper belt receiving opening 30 and a lower belt receiving opening 40. The flexible belt 120 is fed through the lower belt receiving opening 40 and through upper belt receiving opening 30 by placing the distal end 124 of the flexible belt 120 through these openings and moving body 20 until the scent impregnated object 10 rests over the first lengthwise section 126 of the flexible belt 120 and also rests adjacent rimmed cage 100. When in position, a first front portion 42 and second front portion 44 of the object 10 are adjacent the belt section 126 and a rear portion 46 of the object 10 rests behind the belt section 126. Similarly, a first front portion 32 and a second front portion 44 of the object 10 are adjacent the belt section 126 and a rear portion 36 of the object 10 rests behind the belt section 126. In this way, the scent impregnated object also emits a scent which is continuous and which will continuously absorb fowl toilet bowl odors and also mask fowl toilet bowl smells without requiring any activation such as flushing the toilet. The spring tension of the flexible belt 120 retains the scent impregnated object adjacent the interior wall of the toilet bowl.

The scent impregnated object is illustrated to be in the shape of a frog but it will be appreciated that the scent impregnated object can be formed into any shape of any animal, celestial object, geometric shape, or any other aesthetic shape. The object 10 can be molded out of resin, plastic or any other material which will retain a scent. The scent impregnated object 10 has means by which it is removably retained on the means 120 by which the deodorant block retaining member 100 is removably retained on to a toilet bowl rim. The scent provided by the present invention 10 will be continuous and does not require flushing the toilet bowl to activate it as is required by the deodorant block 110. The scent retaining object 10 is preferably a slotted object which can slide on the retaining belt 120. The scent retaining object 10 can be of any color or colors and formed in any desired shape.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An object used in conjunction with a rimmed cage which retains a deodorant block which is activated by coming in contact with water, the rimmed cage having numerous openings so that the deodorant block after it is activated can permeate the area surrounding the rimmed cage with a scent absorbing smell for a short period of time, a flexible belt affixed at its proximal end to the rimmed cage, the flexible belt formed as an elongated belt having a first lengthwise section, a second transverse section, a third lengthwise section and a fourth transverse section terminating in a distal end, the flexible belt made out of spring like material, in use, the flexible belt is positioned over an exterior rim of a toilet bowl so that the distal end is outside the toilet bowl, the sections of the flexible belt resting over the rim of the toilet bowl so that the first lengthwise section and the rimmed cage extend into the toilet bowl and are retained adjacent an interior wall of the toilet bowl above a water line within the toilet bowl, the spring tension of the flexible belt retaining the flexible belt onto the toilet bowl rim, the object comprising:

a. a scent impregnated body having an upper belt receiving opening and a lower belt receiving opening, the flexible belt fed through the lower belt receiving opening and through upper belt receiving opening by placing the distal end of the flexible belt through these openings and moving body until the scent impregnated body rests over the first lengthwise section of the flexible belt with a portion of the body adjacent the flexible belt at the location of the lower belt receiving opening aligned with the flexible belt and a portion of the body resting behind the flexible belt at the location of the lower belt receiving opening and a portion of the body adjacent the flexible belt at the location of the upper belt receiving opening aligned with the flexible belt and a portion of the body resting behind the flexible belt at the location of the upper belt receiving opening, the object and also rests adjacent rimmed cage, so that the scent impregnated body continuously emits a scent which will absorb fowl toilet bowl odors and also mask fowl toilet bowl smells.

2. The object in accordance with claim 1 wherein the scent impregnated body is in the shape of a frog.

3. The object with accordance with claim 1 wherein the shape of the scent impregnated body is selected from the group consisting of an animal, celestial object and geometric shape.

4. The object in accordance with claim 1 where the scent impregnated body is molded out of material selected from the group consisting of plastic and resin.

5. An object used in conjunction with a rimmed cage which retains a deodorant block therein, the rimmed cage attached to a flexible belt made out of spring like material, the flexible belt is positioned over an exterior rim of a toilet bowl so it is retained over the exterior rim of the toilet bowl so that the rimmed cage extends into the toilet bowl and is retained adjacent an interior wall of the toilet bowl above a water line within the toilet bowl, the spring tension of the flexible belt retaining the flexible belt onto the toilet bowl rim, the object comprising:

a. a scent impregnated body having an upper belt receiving opening and a lower belt receiving opening, the flexible belt fed through the lower belt receiving opening and through upper belt receiving opening until the scent impregnated body rests adjacent the rimmed cage, so that the scent impregnated body continuously emits a scent which will absorb fowl toilet bowl odors and also mask fowl toilet bowl smells; and b. a portion of the body adjacent the flexible belt at the location of the lower belt receiving opening is aligned with the flexible belt and a portion of the body resting behind the flexible belt at the location of the lower belt receiving opening and a portion of the body adjacent the flexible belt at the location of the upper belt receiving opening aligned with the flexible belt and a portion of the body resting behind the flexible belt at the location of the upper belt receiving opening.

6. The object in accordance with claim 5 wherein the scent impregnated body is in the shape of a frog.

7. The object in accordance with claim 5 wherein the shape of the scent impregnated body is selected from the group consisting of an animal, celestial object and geometric shape.

8. The object in accordance with claim 5 wherein the scent impregnated body is molded out of material selected from the group consisting of plastic and resin.

* * * * *